US006562286B1

(12) United States Patent
Lehman

(10) Patent No.: US 6,562,286 B1
(45) Date of Patent: May 13, 2003

(54) POST MOUNTING SYSTEM AND METHOD FOR MOLTEN METAL PUMP

(76) Inventor: Dale T. Lehman, 5577 Valley La., Solon, OH (US) 44139

( * ) Notice: Subject to any disclaimer, the term of this patent is extended or adjusted under 35 U.S.C. 154(b) by 0 days.

(21) Appl. No.: 09/804,845

(22) Filed: Mar. 13, 2001

Related U.S. Application Data

(60) Provisional application No. 60/188,722, filed on Mar. 13, 2000.

(51) Int. Cl.[7] ..... C21B 7/12

(52) U.S. Cl. ..... 266/45; 266/239; 417/423.3

(58) Field of Search ..... 222/590, 591, 222/595; 266/239, 45; 417/423.3

(56) References Cited

U.S. PATENT DOCUMENTS

| | | | | |
|---|---|---|---|---|
| 4,786,230 A | | 11/1988 | Thut | 415/88 |
| 5,028,211 A | | 7/1991 | Mordue et al. | 416/204 R |
| 5,092,821 A | | 3/1992 | Gilbert et al. | 464/152 |
| 5,203,681 A | * | 4/1993 | Cooper | 417/424.1 |
| 5,558,505 A | | 9/1996 | Mordue et al. | 417/360 |
| 5,676,520 A | | 10/1997 | Thut | 415/121.3 |
| 5,944,496 A | * | 8/1999 | Cooper | 417/423.3 |
| 5,947,705 A | * | 9/1999 | Mordue et al. | 417/423.15 |

FOREIGN PATENT DOCUMENTS

| | | | | |
|---|---|---|---|---|
| WO | WO 00/28219 | * | 5/2000 | 266/239 |

* cited by examiner

*Primary Examiner*—Scott Kastler
(74) *Attorney, Agent, or Firm*—Pearne & Gordon LLP

(57) ABSTRACT

A molten metal pump includes a base member submerged in the molten metal, a support member supported above the level of the molten metal by a post extending from the base member through a clearance bore in the support member and a coupling securing the post to the support member. The coupling is mounted to the support surface and includes gripping members operable to a locked position engaging the upper end of the post and to an unlocked position releasing the post. The coupling is aligned with the clearance bore in the support member to permit the post to be assembled or disassembled by axial movement through the clearance bore when the coupling is in the unlocked position.

20 Claims, 9 Drawing Sheets

POST MOUNTING SYSTEM AND METHOD FOR MOLTEN METAL PUMP

This application claims the priority of U.S. Provisional Application No. 60/188,722, filed Mar. 13, 2000.

BACKGROUND OF THE INVENTION AND RELATED ART

The present invention relates to pumps, and more particularly to molten metal pump apparatus and methods for assembling and disassembling such apparatus.

There are three basic types of molten metal pumps described in detail in prior U.S. Pat. No. 5,203,681. Generally, a molten metal pump comprises a centrifugal pump modified to provide processing of the molten metal.

The pump typically includes a base or casing having a pumping chamber and an impeller received within the chamber. The base includes inlet and outlet passages for intake and discharge of molten metal being pumped. The pump base together with the impeller are submerged in the molten metal, supported on the bottom of the vessel containing the molten metal. The pump base is connected by refractory cement and/or mechanical arrangements to a plurality of vertically extending members such as risers for conveying molten metal from the vessel and support posts connected to a drive arrangement positioned above the level molten metal. In typical installations, these vertically extending members may be several feet long, e.g. one to four feet in length or longer, in order to provide adequate clearance above the molten metal level. For convenience, the invention is discussed below with particular reference to posts.

The portions of the pump submerged in the molten metal are directly contacted and exposed to the harsh conditions thereof, and they are formed of refractory materials such as graphite, silicon carbide, alumina, zirconia or hexalloy. For example, the submerged components of the pump including the posts may be made of graphite. The posts extend through the level of the molten metal and they are connected to a motor mounting plate which may include a metal plate strength member and a lower insulation layer to protect the motor from the heat of the molten metal.

In prior art arrangements, downwardly opening post sockets are fixed to the motor mounting plate and receive the upper ends of the posts. One or more post sockets may be fixed to a post support plate, as by welding, and the support plate is secured to the motor mounting plate.

A threaded fastener extends through a clearance opening in the motor mounting plate and/or post support plate for threaded engagement with the post along its longitudinal axis. The post may also be secured within the post sockets by means of a refractory cement.

Such prior art arrangements are not entirely satisfactory. The downwardly opening post sockets are often contaminated with splashing molten metal. Also, the quality of the post connection was substantially dependent upon the single threaded fastener. A most significant disadvantage is the need to remove the post support plate and/or the motor mounting plate when it is necessary to replace the post. Such disassembly is time-consuming and results in considerable downtime.

SUMMARY OF THE INVENTION

An improved post mounting structure and assembly/disassembly technique are provided. In accordance with the invention, a more effective post connection is provided that facilitates disassembly. To that end, the post and mounting plate together with any related structural members are dimensioned to allow relative movement of these components upon decoupling them during disassembly.

In accordance with one aspect of the invention, it is not necessary to disassemble the motor mounting plate and/or post support plate for installation and removal of a post.

In accordance with another aspect of the invention, a post mounting coupling compressively grips the post to reinforce the end of the post. This coupling may have a monolithic construction that assures proper alignment of the coupling as it is connected to the end of the post.

In one of the illustrated embodiments, a post mounting passageway which may comprise one or more clearance bores is provided in the motor mounting plate and/or post support plate as well as any aligned insulation layer to permit passage of the post therethrough and into engagement with the pump base. The upper end of the post extends above the motor mounting plate and/or post support plate for engagement with a coupling secured to the mounting plate. The lower end of the post may be mounted to the base in a known manner by refractory cement and/or mechanical connections.

In another illustrated embodiment, the coupling is mounted to a lower surface of the mounting plate or post support plate, and a portion of the coupling extends upwardly through the clearance bore or bores. In such arrangements, the post may be of shorter axial length and the coupling is circumferentially reinforced by the mounting plate.

In another illustrated embodiment, the coupling is again mounted to the lower surface of the mounting plate or post support plate, and no clearance bore or bores are required in the latter. In such embodiment, the upper end of the post is received in the coupling below the level of the mounting plate or post support plate.

The coupling includes gripping members operable between a locked position engaging the upper post end and an unlocked position releasing the upper post end. Preferably, the gripping members have gripping surfaces shaped to correspond with the peripheral surface of the post end, e.g. arcuate gripping surfaces. The gripping members may be retained and/or moved by a locking member such as a mechanical fastener.

In the illustrated embodiment, The coupling comprises a split collar flange coupling that is monolithic and thereby aligns the post relative to the mounting plate and/or post support plate and the cooperating collar gripping portions. Accordingly, once the coupling is fixed to the mounting plate and/or post support plate, the proper axial alignment of the post is assured as well as the orientation and peripheral joint between the collar portions.

In the illustrated embodiments, the flange portion of the coupling is secured to the motor mounting plate and/or post support plate by threaded fasteners. The end of the post is received in the collar portion of the coupling. The split portions of the collar are drawn into tight engagement about the periphery of the post by a locking member. The locking member applies compressive gripping forces to the end of the post or riser, and it comprises a threaded fastener extending through the split portions of the collar and the post or associated pairs of ears radially extending from each split collar portion and secured together by threaded fasteners.

The coupling thereby fixes the longitudinal position and height of the post relative to the motor mounting plate and/or post support plate. The coupling also distributes the coupling or engagement load over substantially the entire circumferential area of the gripping surfaces or collar. In this manner, the prior art concentration of loads along a single threaded connection is avoided.

Advantageously, this distribution of the clamping load is achieved without the use of refractory adhesives. Instead, an easily disengaged and reengaged mechanical connection is used. However, adhesives may be used with the split collar flange coupling, if desired.

Also, it should be appreciated that the split collar flange coupling may be positioned above the motor mounting plate and/or post support plate so as to protect it from splashing molten metal. Further, the upwardly opening coupling orientation tends to inhibit entry therein of splashing molten metal.

DETAILED DESCRIPTION OF THE DRAWINGS

Figure 1:
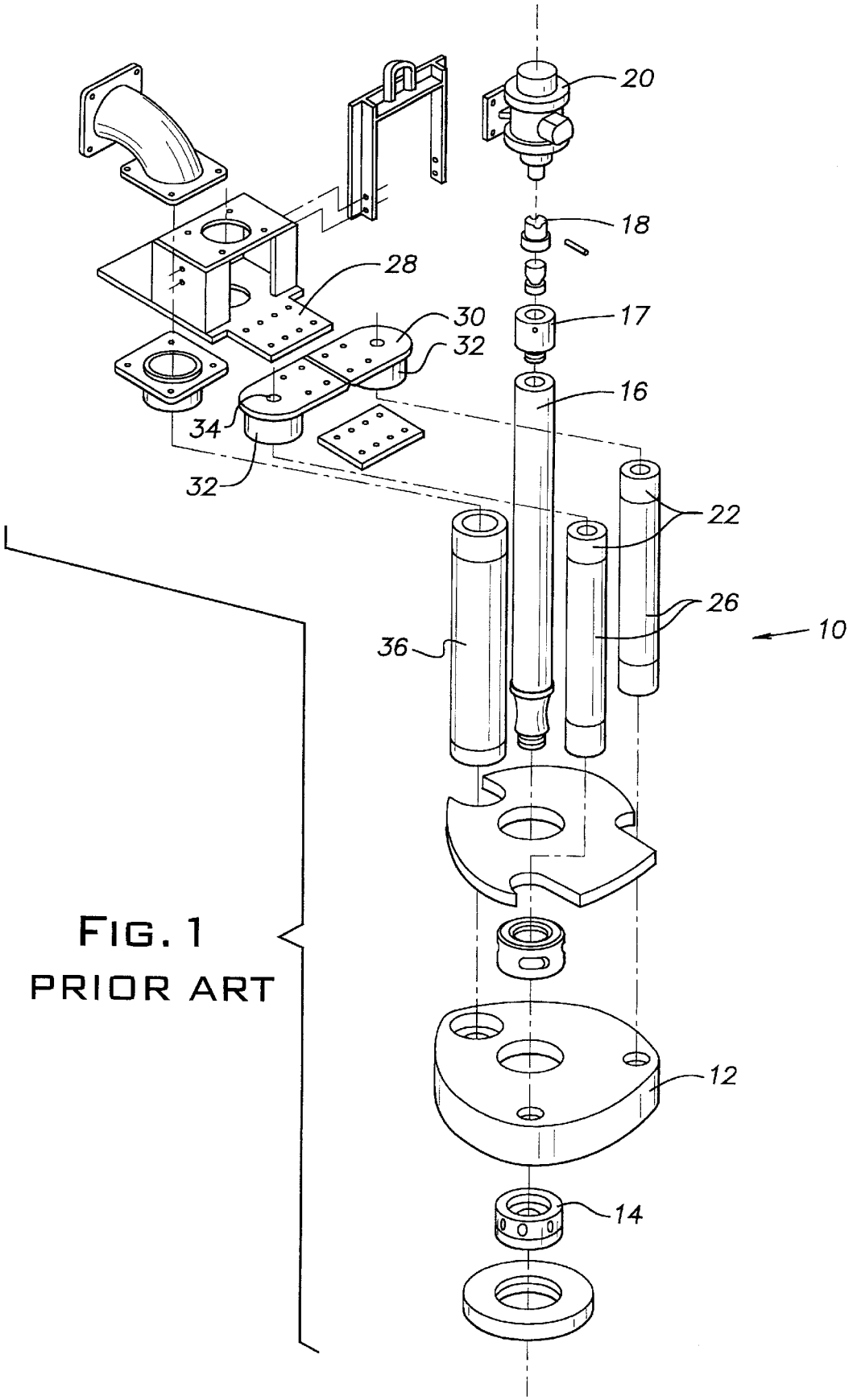
FIG. 1 PRIOR ART
FIG. 1 is an exploded view of a molten metal pump having a post mounting arrangement in accordance with the prior art.

Referring to FIG. 1, a molten metal pump includes a casing or base member 12 having an impeller 14 mounted therein. The impeller 14 is secured to a drive shaft 16 and mounted for rotation within the base member 12. The shaft 16 may be formed of a refractory material such as graphite and provided with a protective coating of another refractory material such as silicon carbide or boron nitride. The upper end of the shaft 16 is connected via a coupling 17 with an upper shaft 18 to a motor 20. The motor 20 may be of any desired type and, for example, may be air or electric driven.

The pump 10 includes two identical support posts 22 positioned at spaced locations. The posts are provided with protective sleeves 26 also formed of a refractory material, for example, as is known in the art. The lower ends of the posts 22 are secured by refractory cement to the base member 12. The upper ends of posts 22 are connected to a motor mounting plate 28. A post support plate 30 may be secured to the motor mounting plate 28 in any convenient manner, such as, threaded fasteners. The post support plate 30 includes a pair of spaced post sockets 32 arranged to receive the top ends of the posts 22. A centrally located fastener bore 34 extends through the post support plate 30 in longitudinal alignment with the axis of the associated post 22. A threaded fastener (not shown) extends through the bore 34 in threaded engagement with the associated post along the longitudinal axis thereof. Refractory cement is also used to secure the end of the post in the post socket.

In order to remove the posts 22 from the pump 10, it is necessary to at least disassemble the post support plate 30 from the motor mounting plate 28. In some prior art arrangements, the post sockets may be secured directly to the motor mounting plate. Also, it may be necessary to remove intermediate insulation layers. Similar problems are encountered upon assembly of prior art post systems. It should also be appreciated that the height of the prior art post relative to the motor mounting plate and/or post support plate may not be adjusted.

The pump 10 is a transfer pump and therefore including a riser 36 for removal of molten metal from the bath. The lower end of the riser 36 is secured by refractory cement to the base member 12. The riser 36 extends to a riser socket 37 attached to the mounting plate 28 and a discharge elbow 38. The molten metal passes through the riser 36 and discharge elbow 38 for removal thereof from the bath.

Figure 3:
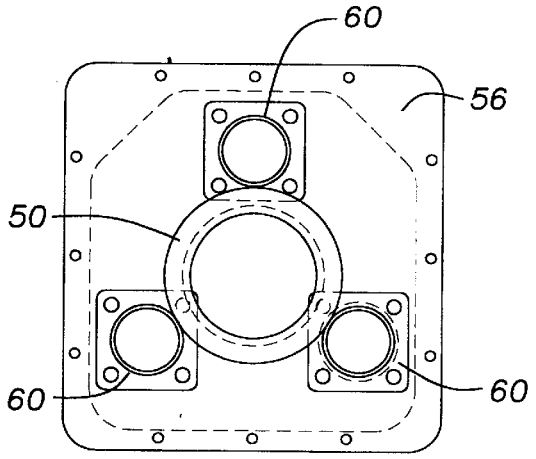
FIG. 3 is a top plan view of the pump shown in FIG. 2.
Figure 2:
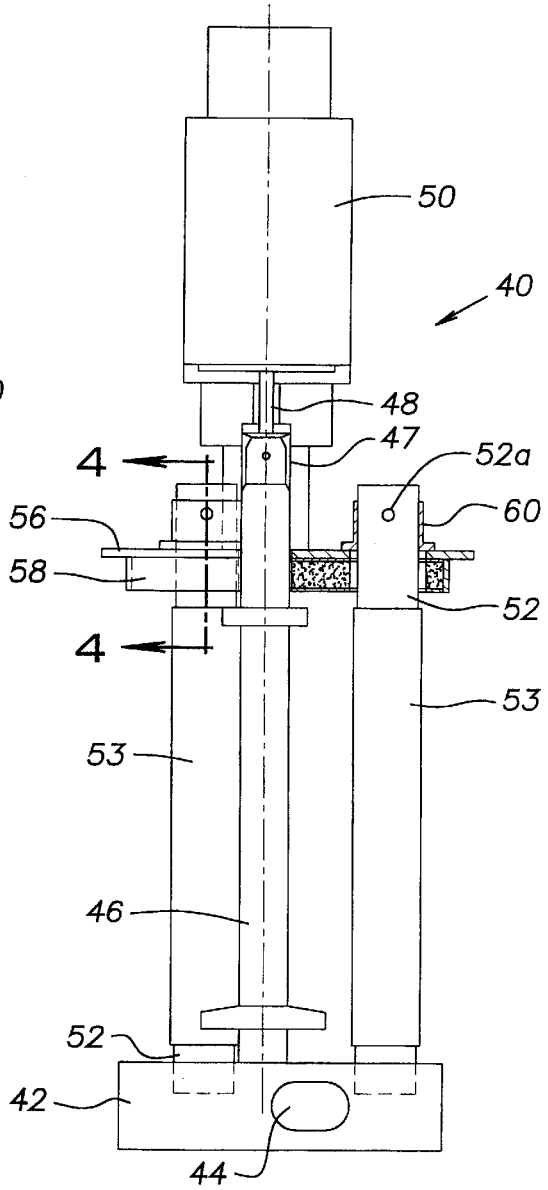
FIG. 2 is a schematic elevational view showing a molten metal pump similar to that in FIG. 1, but having a post mounting system in accordance with the present invention.

Referring to FIGS. 2 and 3, a molten metal pump 40 in accordance with the invention is shown. The pump 40 is a circulation pump and therefore does not include a riser, but it is otherwise generally similar to the pump 10. The main elements of the pump 40 are briefly summarized below. In respect to the pumps 10 and 40, corresponding conventional elements are of similar construction and formed of similar materials.

The pump 40 includes a casing or base member 42 having an impeller 44 therein. The impeller 44 is secured to a drive shaft 46, and the upper end of the drive shaft is connected by a coupling 47 to an upper shaft 48 and motor 50.

The motor 50 and related elements are supported by three identical posts 52 that are spaced apart to provide stability. Each of the posts 52 includes a protective sleeve 53 similar to the sleeve 26. The sleeve 53 is permanently fixed to the post and provides an increased diameter along its length. Typically, the ends of the sleeves 53 do not extend to the longitudinal ends of the posts 52. Accordingly, the upper ends of the posts 52 are mounted by direct mechanical connection with the graphite or other refractory material forming the post. The lower ends of the posts 52 are secured by refractory cement to the base member 42.

Figure 4:
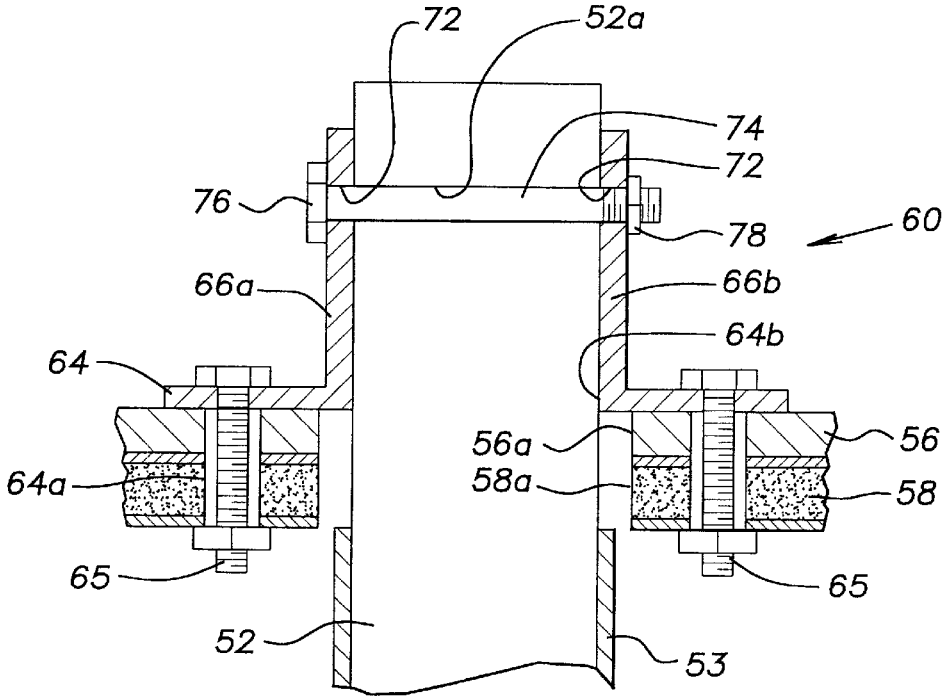
FIG. 4 is a sectional view on an enlarged scale taken along the line 4—4 in FIG. 2.

The motor 50 is supported on a motor mounting plate 56 having a lower heat insulation layer 58. The insulation layer 58 comprises a steel enclosed fiberboard or other suitable insulating material. The posts 52 extend through.associated clearance openings 56*a* and 58*a* respectively extending through the mounting plate 56 and insulation layer 58 as best shown in FIG. 4. The openings 56*a* and 58*a* are dimensioned to enable the post 52 together with the sleeve 53 to pass therethrough with clearance. That is, the clearance openings 56*a*, 58*a* are dimensioned to enable the post 52 and sleeves 53 to be installed and removed by axial movement therethrough.

Each of the posts 52 is connected to the motor mounting plate 56 by a split collar flange coupling 60. The couplings 60 are identical. The coupling 60 is described below in greater detail.

Figure 5:
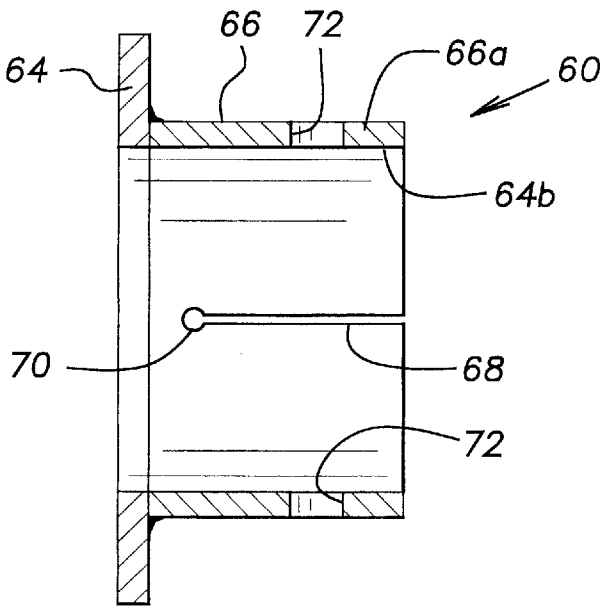
FIG. 5 is a sectional longitudinal view showing the split collar flange coupling.
Figure 6:
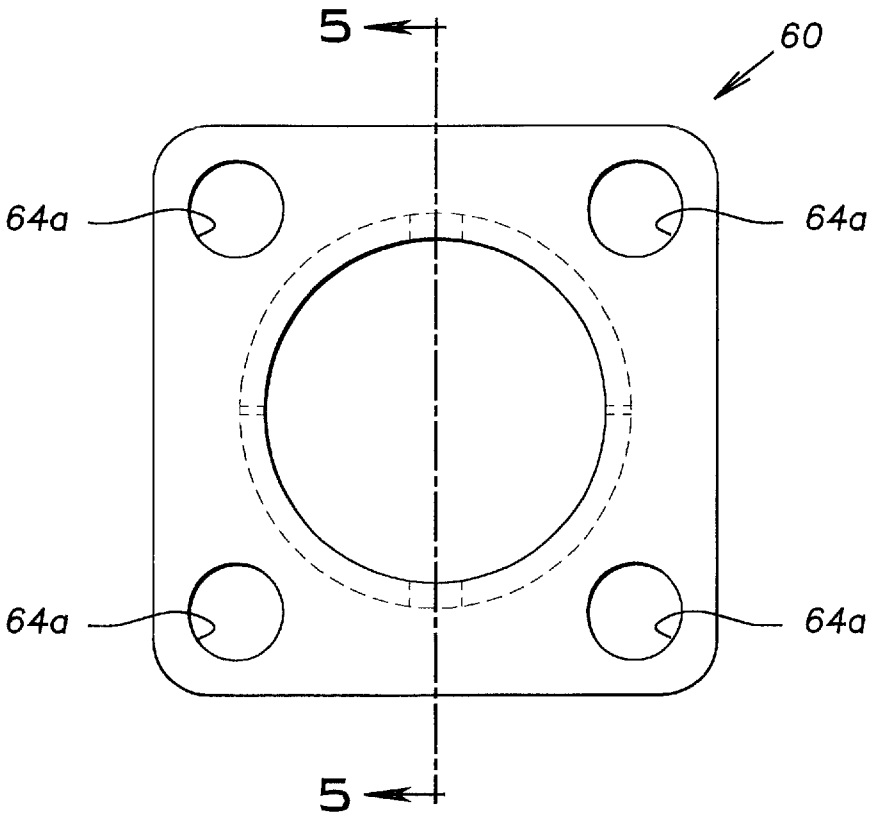
FIG. 6 is a top plan view of the coupling shown in FIG. 4.

Referring to FIGS. 5 and 6, the coupling 60 includes a flange portion 64 and a split collar portion 66. This coupling may be formed as a weldment of a pipe and a plate member as described below in greater detail.

The flange portion 64 includes flange mounting holes 64*a* for receiving mounting fasteners, such as threaded fasteners 65, (FIG. 4) to secure the flange 64 and coupling 60 to the mounting plate 56. The exposed flange surface should be substantially planar to assure a tight fit to the mounting plate.

The split collar portion 66 includes gripping members or collar halves 66*a* and 66*b* formed by a cut or slit 68 extending through a diameter and along a portion of the longitudinal length of the collar portion 66. The slit 68 extends along about 80 to 90 percent of the longitudinal length of the collar and terminates at a stress relieving round 70.

As best shown in FIG. 4, a clearance bore 72 extends through each of the collar halves 66*a* and 66*b* for receiving a threaded locking fastener 74. Herein, the locking fastener 74 comprises a bolt 76 and a nut 78. The bolt 76 extends through a clearance bore 52*a* in the post 52 as best shown in FIGS. 2 and 4. Of course, other types of locking fasteners, such as a band fastener, may be used or the collar halves may be provided with adjacent radially extending ears for receipt of a threaded fastener.

Upon tightening the locking fastener 74, the collar halves 66*a* and 66*b* are brought into tight gripping engagement with the adjacent peripheral surface of the post in order to increase the area of engagement with corresponding reductions in maximum stress loads. In such arrangement, the post is subjected to compression loads and the graphite material forming the post is strongest in compression loading.

As noted above, the coupling 60 may be formed as a weldment of a pipe and a plate. In the illustrated embodiment, a 6.5" square plate having a ⅜" thickness is used to form the flange portion 64 of the coupling 60. Mounting holes 64*a* are provided in the flange portion 64 in order to secure the coupling 60 to the motor mounting plate 56 or the like. The flange portion is provided with a clearance opening 64*b* having a 4" diameter for receiving the end of the post with clearance. As shown in FIG. 4, the flange portion 64 of the coupling 60 extends inward of the clearance openings 56*a* and 58*a*. The coupling 60 has sufficient strength and rigidity to enable stable mounting of the post with this overhang design.

The split collar portion 66 of the coupling 60 is formed by welding a pipe having a 4" I.D. to the flange portion 64, the pipe I.D. and the clearance opening 64*b* being in coaxial alignment. The slit 68 (FIG. 9) is formed by a 1/16" wide saw cut extending along a diameter of the collar portion 66 and through about 90% of its longitudinal length. A ⅛" diameter relief 70 is provided at the end of the slit 68. The clearance bore 72 (FIG. 4) is provided by drilling a ⅝" diameter hole through each of the collar halves 66*a* and 66*b* along a line perpendicular to the plane of the slit 68.

Referring once again to FIG. 2, the mounting of the post 52 may be done without disassembly of the motor mounting plate 56 or insulation layer 58. That is, the coupling 60 may be disengaged by removing the locking fastener 74, the bolts 65 and the collar 60. Assuming the lower end of the post 52 is disconnected from the base member 42, the post 52 and the attached sleeve 53 may be withdrawn upwardly through the openings 56*a* and 58*a* respectively extending through the plate 56 and layer 58. Similarly, the post 52 and sleeve 53 may be refitted to the pump 40 by passing it through the openings 56*a* and 58*a* for engagement of the lower post end with the base member 42. The upper end of the post 52 is then connected to the motor mounting plate 56 by remounting the collar 60 with bolts 65 and engaging the locking fastener 74 with the coupling 60. That is, the bolt 76 is passed through the clearance bore 72 in a first-half 66*a* of the collar portion 66, the bore 52*a* in the post 52, and the clearance bore 72 in the second half 66*b* of the collar portion 66 for engagement with the nut 78. Upon tightening, the post 52 is tightly gripped by the coupling 60 and secured to the motor mounting plate 56.

Figure 7:
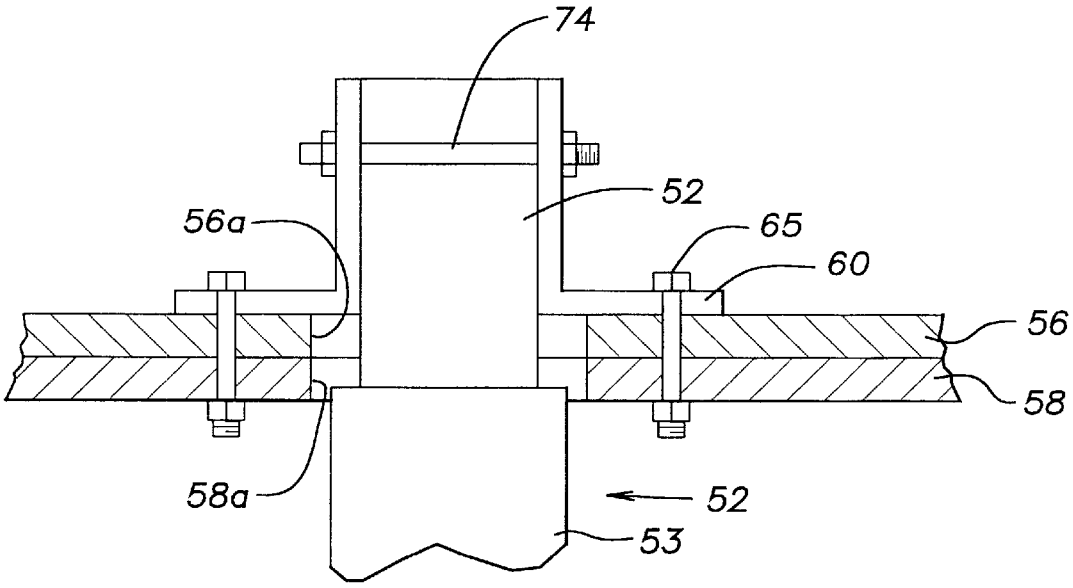
FIG. 7 is a sectional view similar to FIG. 4 showing another embodiment.

Referring to FIG. 7, a modified post mounting arrangement is shown. For convenience, corresponding parts are identified with the same reference numeral.

The coupling 60 is mounted to the top surface of the mounting plate 56 in the same manner as described above. The post 52 similarly extends through the clearance openings 56*a* and 58*a* for engagement in the collar 60. The sleeve 53 may extend into the openings 56*a* and 58*a*. In this arrangement, the fastener 74 does not pass through the post 52. The top end of the post may be butted against the fastener 74 as shown, or it may be slightly spaced from it. In either case, the compressive clamping forces applied to the post 52 by collar 66 are sufficient to stably mount the post and connect it to the plate 56. Moreover, the elimination of the bore 52*a* in the post is advantageous as both a manufacturing efficiency and a strength enhancement.

Figure 8:
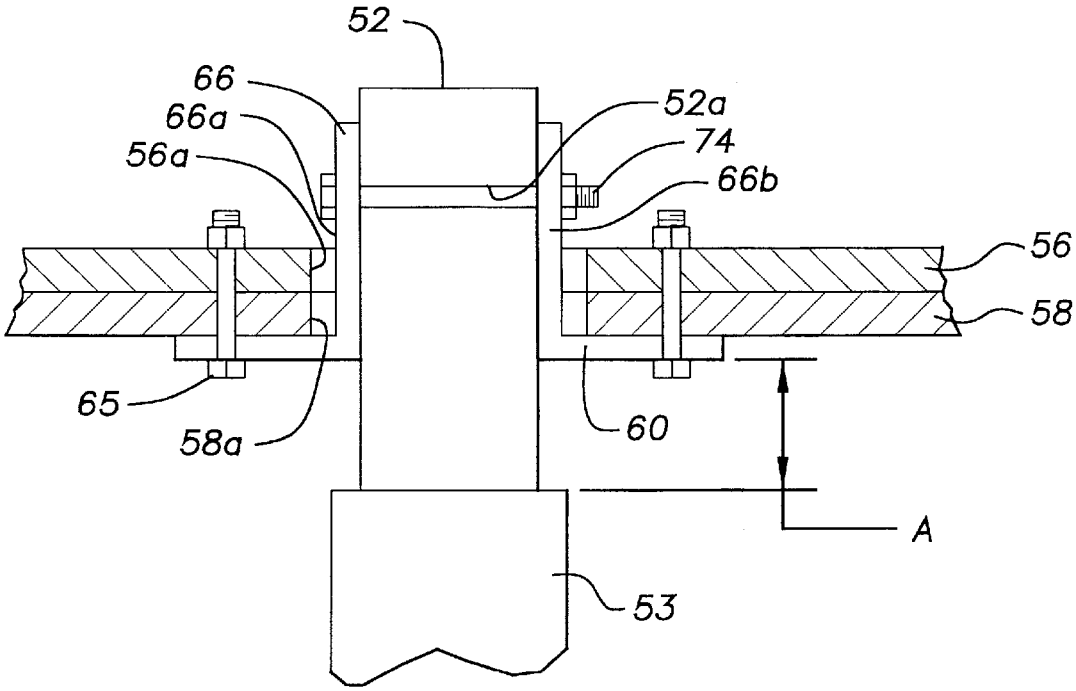
FIG. 8 is a sectional view similar to FIG. 7 showing yet another embodiment.

Another modified post mounting arrangement is shown in FIG. 8. Once again, corresponding parts are identified with the same reference numerals.

The flange 64 of the coupling 60 is mounted below the mounting plate 56 and insulation layer 58. The collar 66 extends upwardly through the insulation layer 58 and the plate 56 to a location above the mounting plate for easy access to the fastener 74. The post 52 extends between the collar halves 66*a* and 66*b* for compressive gripping in the same manner as previously described. As illustrated, the fastener 74 extends through the bore 52*a* in the post 52, but the fastener 74 may abut the end of the post as in the embodiment of FIG. 7.

The mounting of the coupling 60 so that its collar portion 64 is below the plate 56 and the insulation layer 58 requires a "pendulum" removal of the post 52. The fastener 74 is removed and the coupling 60 is disconnected from the members 56, 58 by removal of bolts 65.

The coupling 60 is then axially moved down the post 52 to a lower position engaging the upper end of sleeve 53. For this purpose, the upper end of the sleeve 53 is axially spaced a clearance distance A from the lower extremity of coupling 60 in the assembled or mounted position. This spacing may be several inches, e.g. 3 inches. The lower end of the post 52 is disengaged from the base 42 as by fracture of the refractory cement. The post 52 may then be moved axially upward so as to extend into the clearance openings 56*a* and 58*a*. The lower end of the post 52 is then swung in a pendulum motion to a position clear of the base 12, and then downwardly axially withdrawn from the plate 56 and insulation layer 58.

Figure 9:
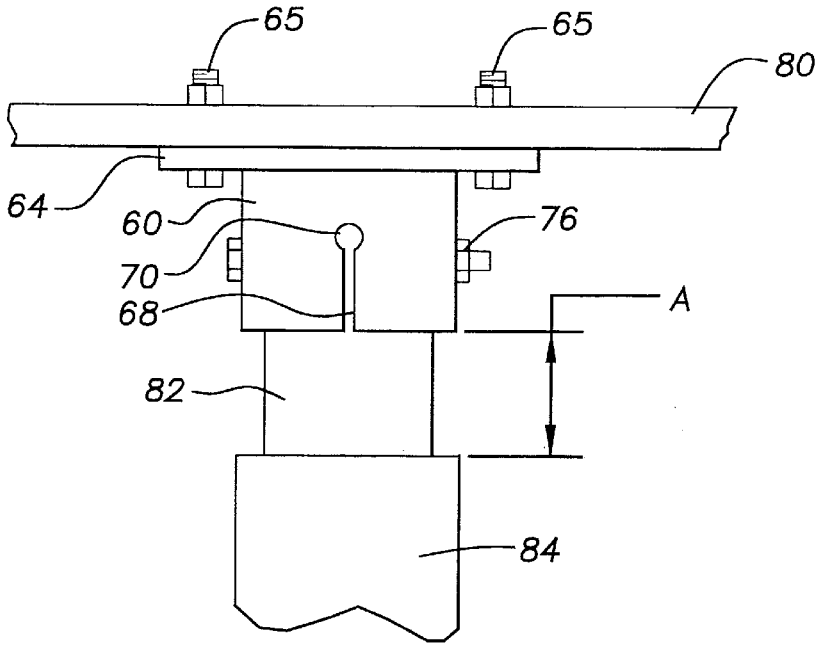
FIG. 9 is a schematic elevational view, partly in section, showing the coupling mounted in an inverted orientation to the lower surface of a motor mounting plate and secured to the top end of a post.

Referring to FIG. 9, the coupling 60 is shown in an inverted mounting position for mounting of the end of the post. The flange portion 64 is secured to the lower surface of a motor mounting plate 80 for receiving the upper end of a post 82. Such an inverted mounting arrangement may be used in order to reduce the required post length. In such an arrangement, the "pendulum" technique as described above with respect to FIG. 8 is used for removing the post 82.

Figure 10:
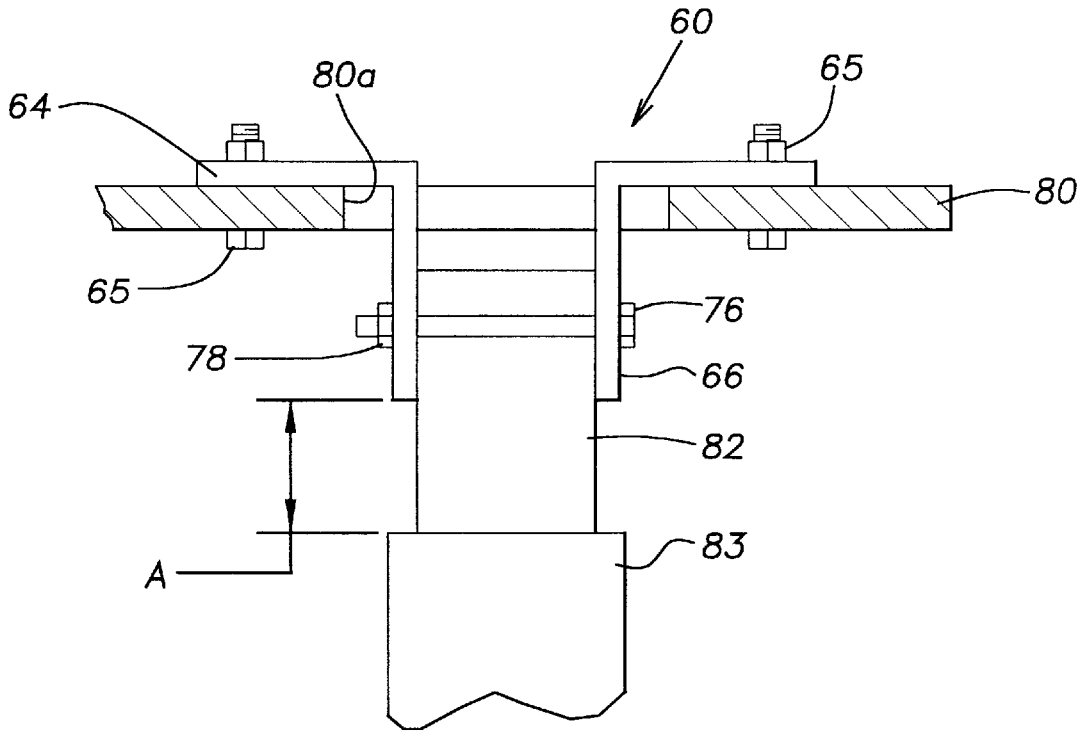
FIG. 10 is a sectional view showing a coupling mounted to the top surface of the motor mounting plate in an inverted orientation.

Referring to FIG. 10, the coupling 60 is shown mounted to a top or upper surface of the motor mounting plate 80 by bolts 65 extending the flange portion 64. The plate 80 includes a clearance opening 80*a* through which the collar portion 66 extends to receive the top or upper end of the post 82. The bolt 76 extends through a bore in the post 82 for threaded engagement with a nut 78 to apply compressive gripping forces to the upper end of the post.

The post 82 may be axially withdrawn from its mounted position by disengagement of the bolts 65. After the coupling 60 is disconnected from the plate 80, the post 82 may be axially moved upwardly through the opening 80*a*. The opening 80*a* is sized to allow passage of the collar portion 66 of the coupling 60 and the sleeve 83 secured to the post 82.

Figure 11:
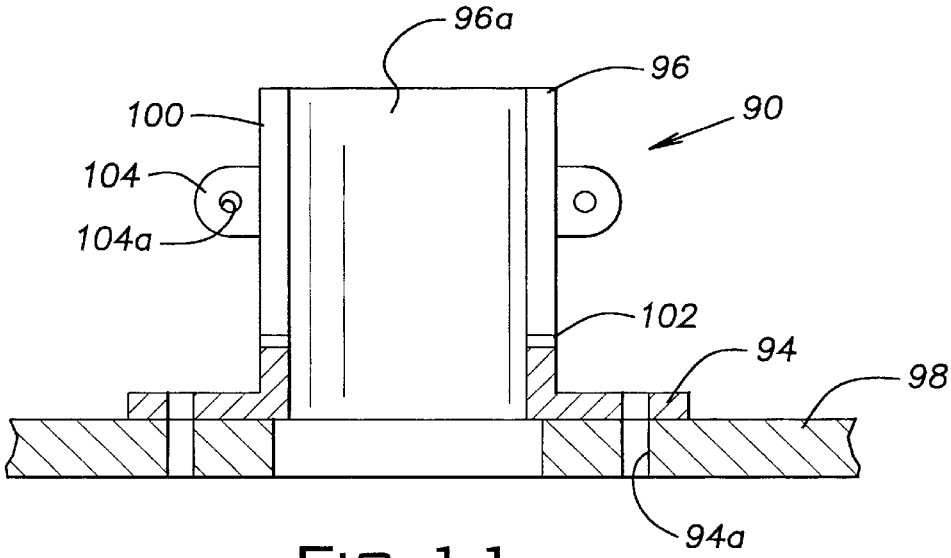
FIG. 11 is a sectional view showing a coupling in accordance with a further embodiment of the invention.
Figure 12:
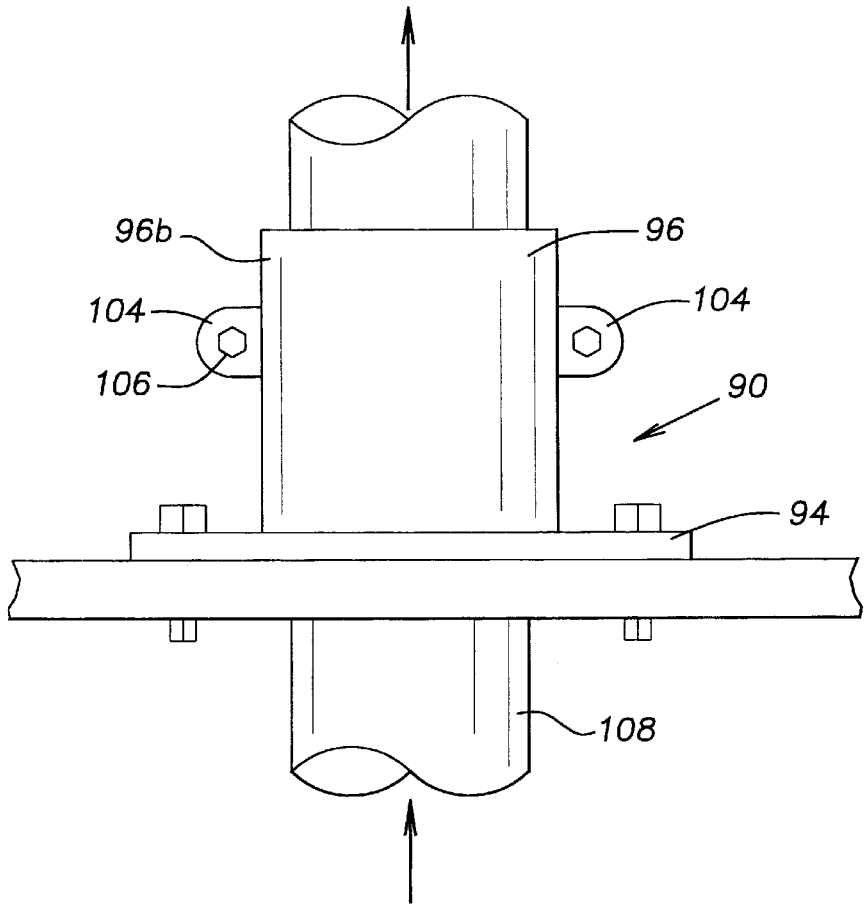
FIG. 12 is a side elevational view showing the coupling of FIG. 11 used to mount a riser pipe.

Referring to FIGS. 11 and 12, a split collar coupling 90 includes a flange portion 94 and a collar portion 96. This coupling may also be formed as a weldment of a pipe and a plate member as described above with respect to prior embodiments.

The flange portion 94 includes flange mounting holes 94*a* for receipt of mounting bolts to secure the coupling to a motor mounting plate 98.

A cut or slit 100 extends in the plane of the drawing in FIG. 11. The slit 100 terminates at a relief 102.

In this embodiment, a pair of mounting ears 104 are provided on each of the collar halves 96*a* and 96*b*. Each of the ears 104 includes a clearance bore 104*a* for receiving a threaded locking fastener 106.

Upon tightening the threaded fasteners 106, the ears 104 and collar halves 96*a* and 96*b* are brought into tight gripping engagement with the adjacent peripheral surface of a riser 108. For purposes of illustration, the riser 108 may be considered similar to the riser 36 and to have a lower end portion secured by a refractory cement to a base member 12 or 42. The riser 108 is hollow and molten metal is pumped therethrough. Accordingly, the coupling 90 with external ears 104 is preferably used in connection with riser installations.

It should be appreciated that the coupling 90 may be mounted below the mounting plate 98 in a manner similar to that shown in the embodiment of FIG. 8. In such an arrangement, the "pendulum" technique as described above with respect to FIG. 8 is used for removing the riser 108.

Figure 13:
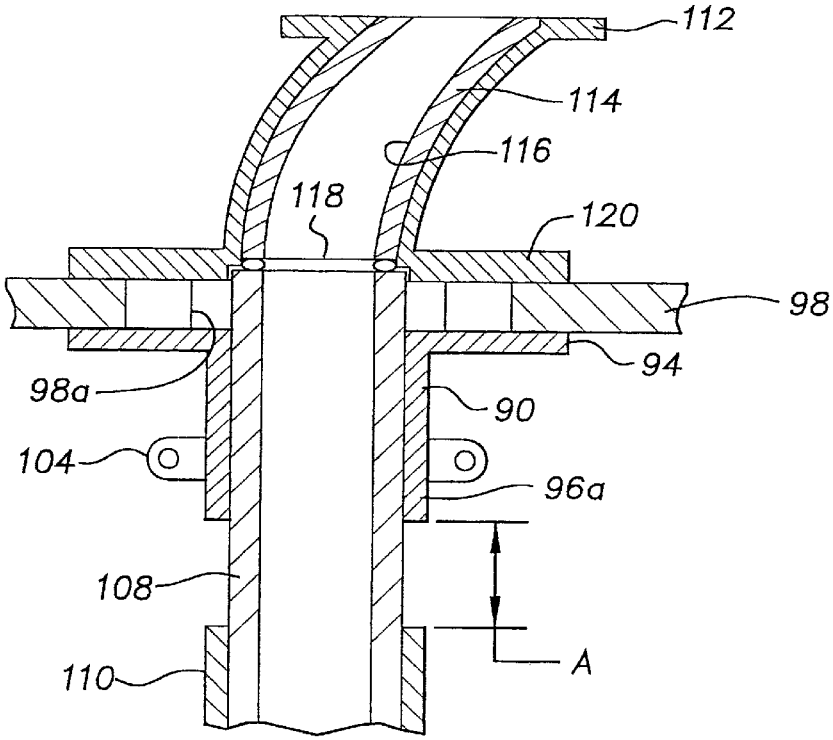
FIG. 13 is a sectional view showing the coupling of FIG. 11 fixed to a lower surface of the mounting plate for connecting a riser to a conduit.

Referring to FIG. 13, the coupling 90 is shown mounted to the lower surface of the plate 98 in a manner similar to that shown in the embodiment of FIG. 9. The riser 108 extends through a clearance opening 98*a* in the plate 98. The opening 98*a* is sized to permit passage of the riser 108 together with its protective sleeve layer 110 upon disassembly. As shown in FIG. 13, the riser 108 terminates just above the upper surface of the plate 98 for fluid tight engagement with an elbow or connecting pipe 112. The elbow 112 includes a protective liner 114 that defines a passageway 116 for conveyance of molten metal. A suitable sealing gasket 118 is disposed between the terminal extremity of the riser 108 and the adjacent end of the passageway 116 through the elbow 112. The elbow 112 includes a flange 120 which may be bolted to the plate 98 in order to assure a fluid tight connection. The "pendulum" technique is again used to disassemble the riser 108 from the pump.

Figure 14:
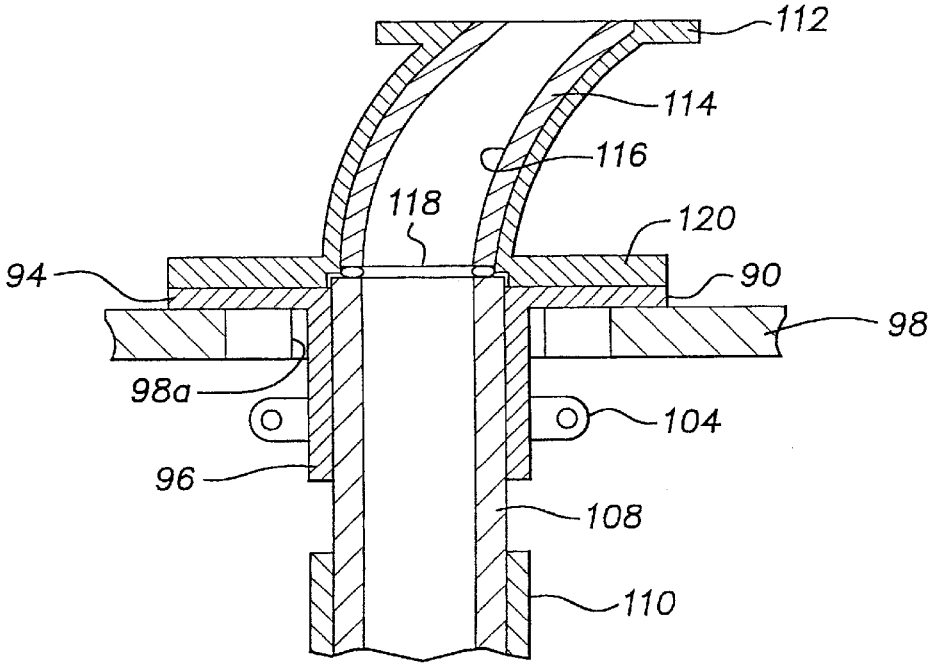
FIG. 14 is a sectional view similar to FIG. 13 showing the coupling mounted to the top surface of the motor mounting plate in an inverted orientation.

Referring to FIG. 14, the coupling 90 is mounted to a top or upper surface of the motor mounting plate 98 by bolts 65 extending through the flange portion 94. The collar portion 96 of the coupling 90 extends through the clearance opening 98*a* in the plate 98 to receive the top or upper end portion of the riser 108. The riser 108 terminates just above the flange portion 94 of the coupling 90 for fluid tight engagement with the elbow 112. In this embodiment, the flange portion 120 of the elbow 112 may be bolted to the plate 98 by bolts (not shown) extending through clearance bores in the flange portion 64 of the coupling 60.

Figure 15:
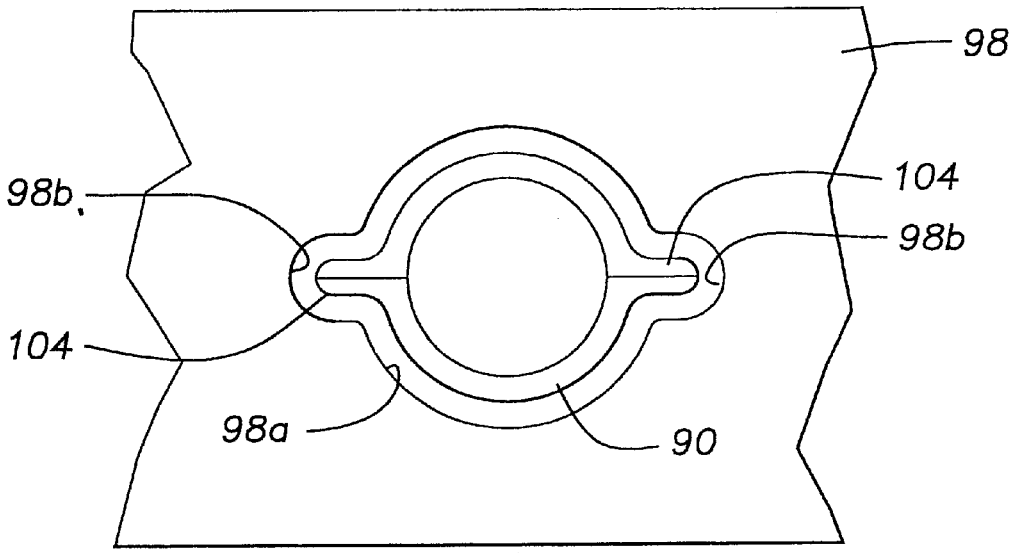
FIG. 15 is a schematic top view showing the clearance opening in the motor mounting plate and the coupling aligned for axial passage therethrough.

The riser 108 may be removed from the pump by disconnection and removing the elbow 112. The coupling 90 is then disconnected from the plate 98. The lower end of the riser 108 is disengaged from the base member by breaking the refractory cement connection therewith. The riser 108 and coupling 90 may be rotated to align the ears 104 with clearance slots or openings 98b (FIG. 15) located along the periphery of the openings 98*a*. Upon proper alignment, the riser 108 with the mounted coupling 90 may be passed axially upward through the clearance openings 98*a* and 98*b*.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed:

1. A molten metal pump including a base member to be submerged in molten metal, a support member supported above the level of the molten metal by at least one post extending from said base member to said support member, said post having a longitudinal length extending from said base to an upper end adjacent said support member, and a monolithic coupling securing said post to said support member, said coupling comprising a one-piece flange and collar for receiving an upper end of said post, said flange being removably mounted to said support member to therefore fix the position of the said flange with respect to said support member, said collar being sized to receive said upper end of said post and having an axial length adapted to extend longitudinally along said upper end of said post, said collar including gripping members operable to a locked position engaging said post and an unlocked position releasing said post, said collar being slit along at least a portion of its axial length to form said gripping members, said coupling also including locking means operable to move said gripping members toward each other to engage said upper end of said post in said locked position and away from each other to disengage said upper end of said post in said unlocked position, said flange remains in said fixed position relative to said support member.

2. A molten metal pump as set forth in claim 1, wherein said support member has a clearance bore sized to permit said post to pass through said bore and said support member when said gripping members are operated to said unlocked position.

3. A molten metal pump as set forth in claim 2, wherein said flange member is mounted above said support member.

4. A molten metal pump as set forth in claim 2, wherein said flange is mounted below said support member.

5. A molten metal pump as set forth in claim 1, wherein said support member has a clearance bore sized to receive said upper end of said post with clearance, said upper end of said post having an axial length sufficient to permit upward axial movement of said post and pivotal movement of said post clear of said base member to remove said post upon operation of said gripping members to said unlocked position.

6. A molten metal pump as set forth in claim 1, wherein said gripping members include bores and said locking means comprise a threaded fastener extending through said bores in said gripping members.

7. A molten metal pump including a base member to be submerged in molten metal, a support member supported above the level of the molten metal, at least one riser extending from said base member to said support member, and a monolithic coupling securing said riser to said support member, said coupling comprising a one-piece flange and collar for receiving an upper end of said riser, said flange being removably mounted to said support member to therefore fix the position of the said flange with respect to said support member, said collar being sized to receive said upper end of said riser and having an axial length adapted to extend longitudinally along said upper end of said riser, said coupling including gripping members operable to a locked position engaging said riser and an unlocked position releasing said riser, said collar being slit along at least a portion of its axial length to form said gripping members, said coupling also including locking means operable to move said gripping members toward each other to engage said upper end of said riser in said locked position and away from each other to disengage said upper end of said post in said unlocked position, said flange remains in said fixed position relative to said support member.

8. A molten metal pump as set forth in claim 7, wherein said support member has a clearance bore sized to permit said riser to pass through said bore and said support member when said gripping members are operated to said unlocked position.

9. A molten metal pump as set forth in claim 8, wherein said flange member is mounted above said, support member.

10. A molten metal pump as set forth in claim 8, wherein said flange member is mounted below said support member.

11. A molten metal pump as set forth in claim 8, wherein said locking means comprise ears fixed to each of said collars.

12. A molten metal pump as set forth in claim 11, wherein said locking means also include threaded fasteners extending through aligned ears on each of said collars for securing said collars together.

13. A method of assembling a molten metal pump including a base member to be submerged in molten metal, a support member supported above the level of said molten metal, at least one post or riser element having a longitudinal length extending from said base member to an upper end portion adjacent said support member, comprising the steps of providing a clearance bore in said support member through which said element passes and a monolithic coupling comprising a one-piece flange and collar having movable gripping members for securing said upper end of element to said support member, fixing said coupling to said support member to therefore fix the position of the said flange with respect to said support member, moving said element axially through said clearance bore in said support member and into engagement with said base member, and securing said coupling to said element by moving said gripping members into locking engagement with said upper end portion of said element while said flange remains in said fixed position relative to said support member.

14. A method as set forth in claim 13, wherein the step of moving said gripping members into locking engagement includes fixing said gripping members to said upper end portion of said element using a threaded fastener.

15. A method of disassembling a post or riser element having a length extending between a lower end portion mounted to a base member and an upper end portion mounted to a support member of a molten metal pump, comprising the steps of providing a clearance opening in said support member for receiving said upper end portion of said element and a monolithic coupling having gripping members for detachably connecting said upper end portion of said element to said support member, said coupling encircling said element and being axially movable along its length upon detachment from said element and support member, detaching said coupling from said element and said support member, moving said coupling along the length of said element and away from said support member, moving said element upward and into said clearance opening to disengage said lower end portion of said element from said base member, pivoting said disengaged lower end portion of said element to a position clear of said base member, and moving said element away from said support member.

16. A method as set forth in claim 15, wherein said coupling comprises a one-piece flange and collar, said collar providing said gripping members.

17. A molten metal pump as set forth in claim 2, wherein said collar extends through said clearance bore in said support member.

18. A molten metal pump as set forth in claim 8, wherein said collar extends through said clearance bore in said support member.

19. A molten metal pump as set forth in claim 2, wherein said coupling is formed as a weldment of said flange and collar.

20. A molten metal pump as set forth in claim 8, wherein said coupling is formed as a weldment of said flange and collar.

* * * * *